US009831054B2

(12) United States Patent
Chen et al.

(10) Patent No.: US 9,831,054 B2
(45) Date of Patent: Nov. 28, 2017

(54) INSULATED THERMAL CUT-OFF DEVICE

(71) Applicants: Littelfuse, Inc., Chicago, IL (US); Littelfuse Japan G.K., Kawasaki-shi (JP)

(72) Inventors: Jianhua Chen, Sunnyvale, CA (US); Weiqing Guo, Palo Alto, CA (US); Minh V. Ngo, San Jose, CA (US); Robert D Hilty, Sunnyvale, CA (US); Arata Tanaka, Ryugasaki (JP)

(73) Assignee: Littelfuse, Inc., Chicago, IL (US)

( * ) Notice: Subject to any disclaimer, the term of this patent is extended or adjusted under 35 U.S.C. 154(b) by 212 days.

(21) Appl. No.: 14/228,196

(22) Filed: Mar. 27, 2014

(65) Prior Publication Data

US 2015/0279596 A1 Oct. 1, 2015

(51) Int. Cl.

| | |
|---|---|
| ***H01H 37/52*** | (2006.01) |
| *H01H 9/04* | (2006.01) |
| *H01H 37/54* | (2006.01) |

(52) U.S. Cl.

CPC ..... *H01H 37/52* (2013.01); *H01H 37/5427* (2013.01); *H01H 9/04* (2013.01); *H01H 37/54* (2013.01); *H01H 2037/528* (2013.01)

(58) Field of Classification Search

CPC ..... H01H 37/52; H01H 37/5427; H01H 2037/528; H01H 37/54; H01H 9/04

(Continued)

(56) References Cited

U.S. PATENT DOCUMENTS 1,852,333 A * 4/1932 Phelan ..... H01H 37/52 236/68 R
2,347,014 A * 4/1944 Willmann ..... G01K 5/62 236/68 B (Continued)

FOREIGN PATENT DOCUMENTS

DE 102012112207 B3 2/2014
EP 2299465 A1 3/2011

(Continued)

OTHER PUBLICATIONS

International Search Report for International Application No. PCT/US2015/022918, dated Jun. 29, 2015.

*Primary Examiner* — Anatoly Vortman

(57) ABSTRACT

A thermal cut-off device includes a plastic base, two electrodes, a temperature sensing element, and a plastic cover that fits over the base. The temperature sensing element is curved downward, and may be a bimetal or a trimetal. When the device is subject to an over-temperature condition, the orientation of the curve flips such that the temperature sensing element is then curved upward. When the temperature sensing element is curved upward, it lifts an arm of one of the electrodes, which severs the electrical connection between the electrodes. In this manner the device shuts off during an over-temperature condition in order to protect the circuit in which the device is installed. To prevent corrosion of the temperature sensing element, a first moisture insulation layer is applied to the outer surface of the thermal cut-off device. The moisture insulation layer may be an epoxy adhesive or a UV/visible light-cured adhesive or light/heat cured adhesive. In some embodiments, a second moisture insulation layer is formed on the surface of the temperature sensing element.

20 Claims, 6 Drawing Sheets

(58) Field of Classification Search
USPC ..... 337/102, 111, 362, 379
See application file for complete search history.

(56) References Cited

U.S. PATENT DOCUMENTS 2,800,555 A * 7/1957 Sundt ..... H01H 81/02 29/621
2,821,836 A * 2/1958 McCorkle, Sr. ... G05D 23/1921 337/417
3,295,081 A * 12/1966 Bowyer ..... H01H 37/585 335/208
3,474,372 A * 10/1969 Davenport ..... H01H 35/183 337/1
3,491,323 A * 1/1970 Molgard ..... B05D 7/14 337/111
3,665,360 A * 5/1972 Norden ..... H01H 37/14 337/100
3,767,370 A * 10/1973 Ornstein ..... B32B 15/013 428/617
3,842,382 A * 10/1974 Bell ..... H01H 61/02 337/107
4,016,523 A * 4/1977 Sidor ..... H01H 37/764 337/403
4,115,624 A * 9/1978 Izbicki ..... B32B 15/011 428/617
4,121,184 A * 10/1978 Dinkler ..... H01H 37/585 335/146
5,276,422 A * 1/1994 Ikeda ..... H01H 77/04 337/16
5,573,860 A * 11/1996 Hirano ..... B32B 15/01 428/616
5,877,671 A * 3/1999 Hofsass ..... H01H 37/5427 337/333
6,396,381 B1 * 5/2002 Takeda ..... H01H 1/504 337/342
6,633,222 B2 * 10/2003 Nagai ..... H01H 37/54 337/333
6,949,825 B1 * 9/2005 Guenther ..... H01L 51/524 257/684
7,330,097 B2 * 2/2008 Takeda ..... H01H 1/504 337/102
7,800,477 B1 * 9/2010 Komer ..... H01H 37/5436 337/102
8,289,124 B2 * 10/2012 Hofsaess ..... H01H 37/5427 337/333
9,159,985 B2 * 10/2015 Nakanishi ..... H01H 37/14
2010/0047674 A1 * 2/2010 Ryu ..... H01H 37/48 429/62
2014/0167907 A1 6/2014 Hofsaess

FOREIGN PATENT DOCUMENTS

JP S5842752 U 3/1983
JP H07234292 A 9/1995
JP 2006156064 A 6/2006
WO WO-2012/169442 A1 12/2012

* cited by examiner

INSULATED THERMAL CUT-OFF DEVICE

BACKGROUND

I. Field

The present invention relates generally to electronic protection circuitry. More, specifically, the present invention relates to an insulated thermal cut-off device.

II. Background Details

Protection circuits are often times utilized in electronic circuits to isolate failed circuits from other circuits. For example, the protection circuit may be utilized to prevent damage from an electrical or thermal fault condition in an electrical circuit, such as in lithium-ion battery packs. Protection circuits may also be utilized to guard against more serious problems, such as a fire caused by a power supply circuit failure.

Some circuit protection devices use a temperature sensing element. Temperature sensing elements can become corroded under high temperature and moisture environments, particularly from moisture with acetate ion and/or acid content. A corroded temperature sensing element may not work properly, causing the circuit protection device to fail. Acetate ions and/or acid content often exist in the thermal cut-off application environment. An electrical insulation tape is often used to isolate the thermal cut-off device and prevent any metal-to-metal contact of the thermal cut-off with other components on a printed circuit board or other substrate. The adhesive of the electrical insulation tape may contain acetate ions and/or acid content, which may be released under a high temperature and high humidity environment. Further, temperature sensing elements comprising materials with better corrosion resistance to acids and other corrosive compounds may have a limited deflection and their thermal expansion characteristics may not be sufficient to allow the manufacture of the desired small devices. Small size thermal cut-off devices are desirable; but to guard against corrosion a designer must sacrifice reliability of the devices for miniaturization.

SUMMARY

A thermal cut-off device includes a plastic base, two electrodes, a temperature sensing element, and a plastic cover that fits over the base. The temperature sensing element is curved downward, and may be a bimetal or a trimetal. When the device is subject to an over-temperature condition, the orientation of the curve flips such that the temperature sensing element is then curved upward. When the temperature sensing element is curved upward, it lifts an arm of one of the electrodes, which severs the electrical connection between the electrodes. In this manner the device shuts off during an over-temperature condition in order to protect the circuit in which the device is installed. To prevent corrosion of the temperature sensing element, a moisture insulation layer is applied to the outer surface of the thermal cut-off device. The moisture insulation layer may be an epoxy adhesive or a UV/visible light-cured adhesive or a light/heat curable adhesive.

DETAILED DESCRIPTION

Figure 1:
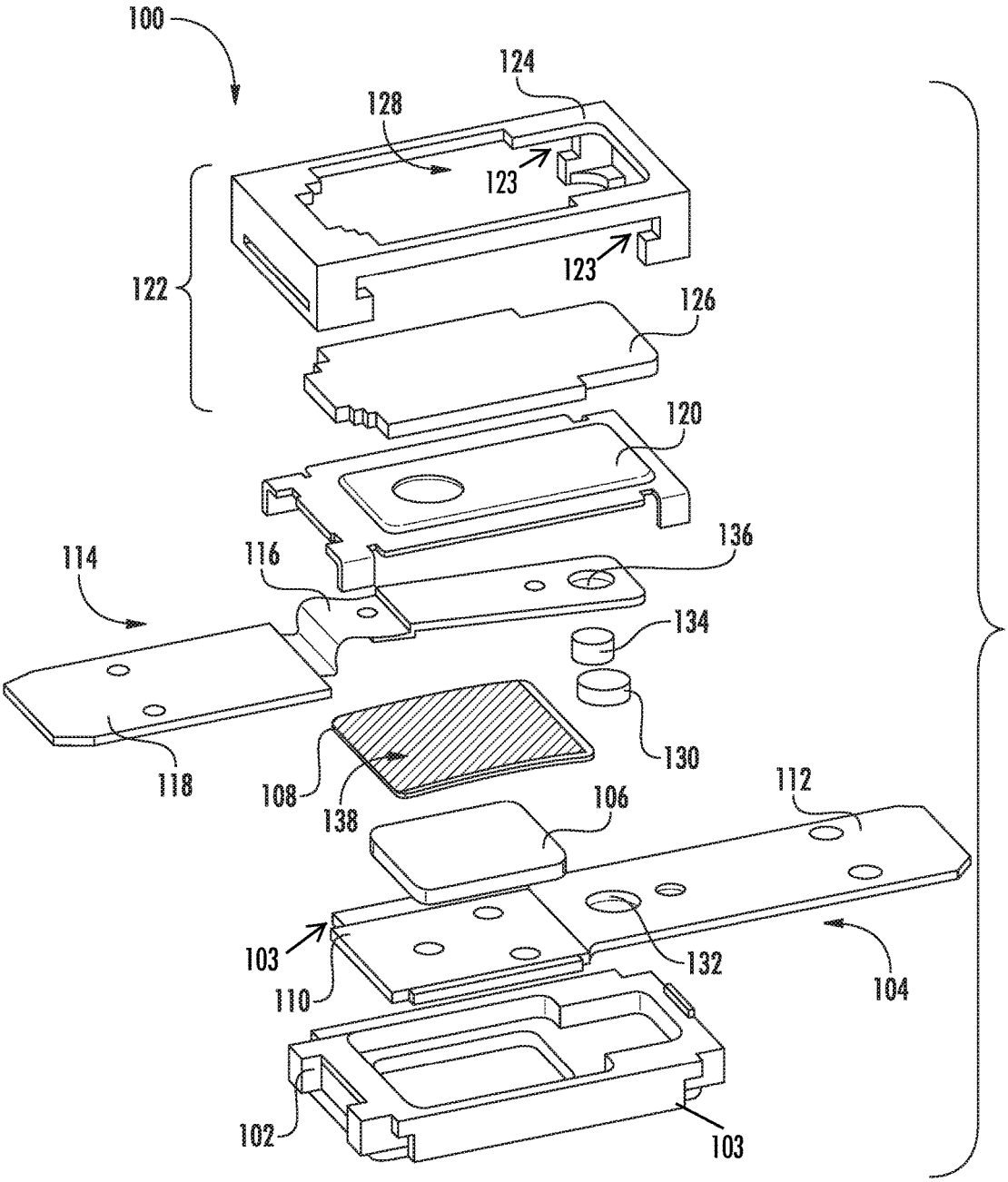
FIG. 1 shows elements of an example of a thermal cut-off device 100 for circuit protection.

FIG. 1 shows elements of an example of a thermal cut-off device 100 for circuit protection. The device includes a plastic base 102, a first electrode 104, a positive temperature coefficient (PTC) chip 106, and a bimetal plate 108. The first electrode 104 includes a portion 110 in contact with the PTC chip 106 and a terminal portion 112 that extends laterally past the edge of the plastic base 102. The device further includes a second electrode 114 positioned above the temperature sensing element 108. The second electrode 114 includes a spring arm portion 116 that is directly above the temperature sensing element 108 and a terminal portion 118 that extends away from another edge of the plastic base 102. The device includes a metal plate 120 above the spring arm portion 116 of the second electrode 114 and a plastic cover 122 having longitudinal t-slots 123 that fits over the below structure and fits to t-shaped longitudinal portions 103 of the plastic base 102. The plastic cover 122 includes a cover frame 124 and an over-mold 126 that fits into an opening 128 defined in the frame 124. The device further includes a metal contact 130 that is clamped into an opening 132 in the terminal portion 112 of the first electrode 104, and another metal contact 134 that is clamped into an opening 136 in the spring arm portion 116 of the second electrode 114. At installation into a circuit, the metal contacts 130 and 134 are in contact with each other, thus forming an electrical path from the terminal portion 112 of the first electrode 104 to the terminal portion 118 of the second electrode 114.

The temperature sensing element 108 has a curved shape. In FIG. 1, the temperature sensing element 108 curves downward, or in other words, the temperature sensing element 108 has a concave surface facing downward toward the PTC chip 106. The temperature sensing element 108 may be a bimetal such as Cu—Ni—Mn/Ni—Fe or Ni—Cr—Fe/Ni—Fe, trimetal such as Ni—Cu/Cu—Ni—Mn/Ni—Fe. The multiple layers of the bimetal or trimetal may include a high expansion layer as one of the layers, e.g. Cu—Ni—Mn or Ni—Cr—Fe, and a low expansion layer, e.g. Ni—Fe, below the high expansion layer. The temperature sensing element 108 may be coated with a second moisture insulation layer 138, such as a contact anti-corrosion lubricant or a contact coating. The contact anti-corrosion lubricant may provide a thin hydrophobic wax-based coating. The contact coating may be a hydrophobic fluorinated polymer. The second moisture insulation layer provides an electrically penetrable thin coating, i.e. electrical current can penetrate and pass through the coating. The PTC chip 106 may be a polymeric positive temperature coefficient (PPTC) chip or a ceramic positive temperature coefficient (CPTC) chip.

Figure 2:
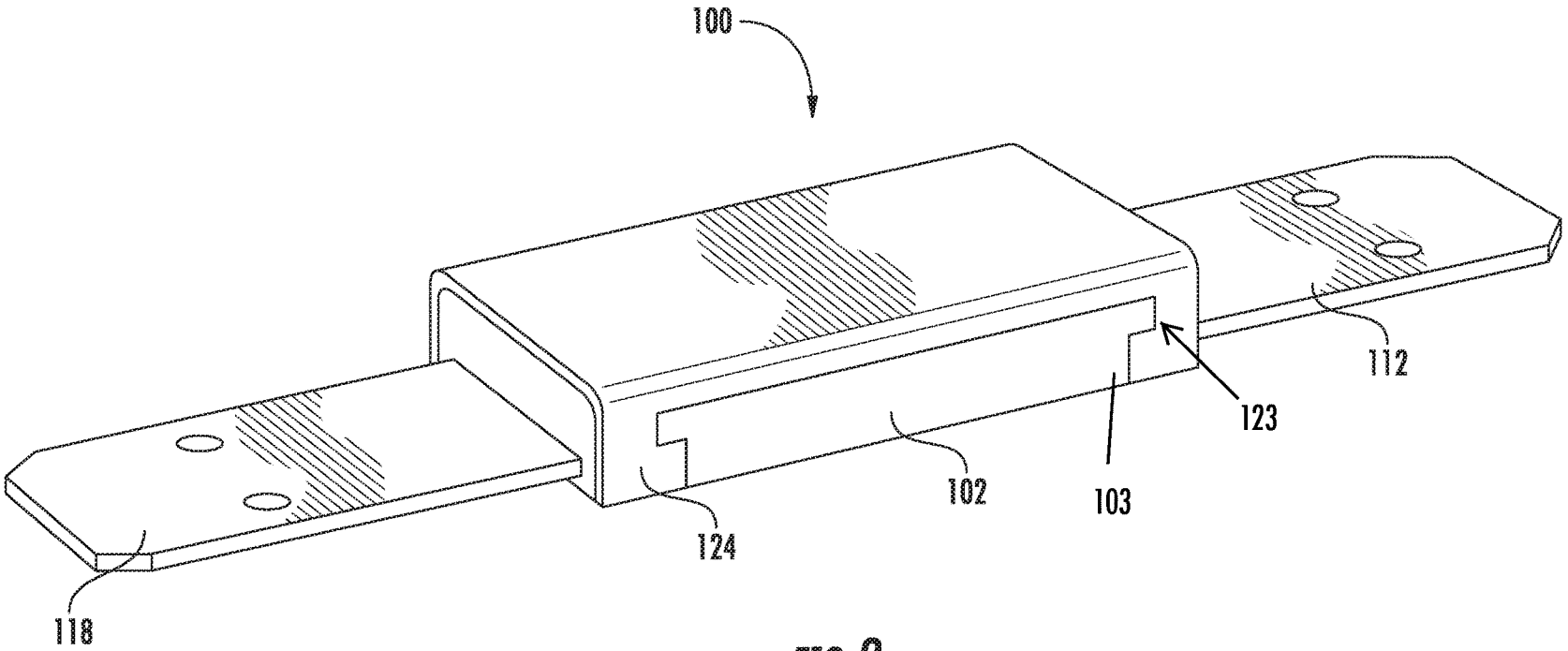
FIG. 2 shows an assembled thermal cut-off device as shown in FIG. 1.

FIG. 2 shows an assembled thermal cut-off device 100, including the plastic cover 122 fitted over the plastic base 102, so that the t-shaped longitudinal portion 103 is received in the longitudinal t-slot 123, with the terminal portion 112 of the first electrode 104 and terminal portion 118 of the second electrode 114 extending away from the base 102. The device 100 is connected with the circuit-to-be-protected through the terminal portions 112 and 118.

A height of the device 100 may be about 0.88 mm, or between about 0.83 mm and about 0.93 mm. A height of the terminal portions 112 and 118 of the electrodes 104 and 114 may be about 0.10 mm, or between about 0.09 mm and about 0.11 mm. A width of the device 100 extending along a first axis from the end of the terminal portion 112 to the end of the terminal portion 118 is about 11.2 mm, or between about 10.9 mm and about 11.5 mm. A width of the plastic casing (including the base 102 and cover 122) along the first axis may be about 4.6 mm, or between about 4.5 mm and about 4.7 mm. The terminal portions 112 and 118 may extend past the casing along the first axis by about 3.3 mm, or between about 3.2 mm and 3.4 mm. A depth of the plastic casing along a second axis that is perpendicular to the first axis is about 2.8 mm, or between about 2.7 mm and about 2.9 mm. A depth of the terminal portions 112 and 118 along the second axis direction is about 2.0 mm, or between about 1.9 mm and 2.1 mm.

During operation, when an over-temperature condition occurs, the PTC chip 106 would heat up and cause the temperature sensing element 108 to flip its orientation due to its layering of high expansion layer above a low expansion layer. In other words, at installation the concave surface (bottom surface facing the PTC chip 106) of the temperature sensing element 108 is facing downward, but the heating due to an over-temperature condition would cause temperature sensing element 108 to curve upwards, such that the top surface of the temperature sensing element 108 is then the concave surface. When the temperature sensing element 108 "flips", the edges of the temperature sensing element 108, which were previously angled downwards and are now angled upwards, exert an upward force on the spring arm 116 of the second electrode 114. This upward force lifts the spring arm 116 and the metal contact 134 which is clamped into the hole defined in the spring arm 116, such that the metal contacts 130 and 134 are no longer in contact, thereby severing the electrical connection between the terminal portions 112 and 118 and turning off the device 100.

Figure 3:
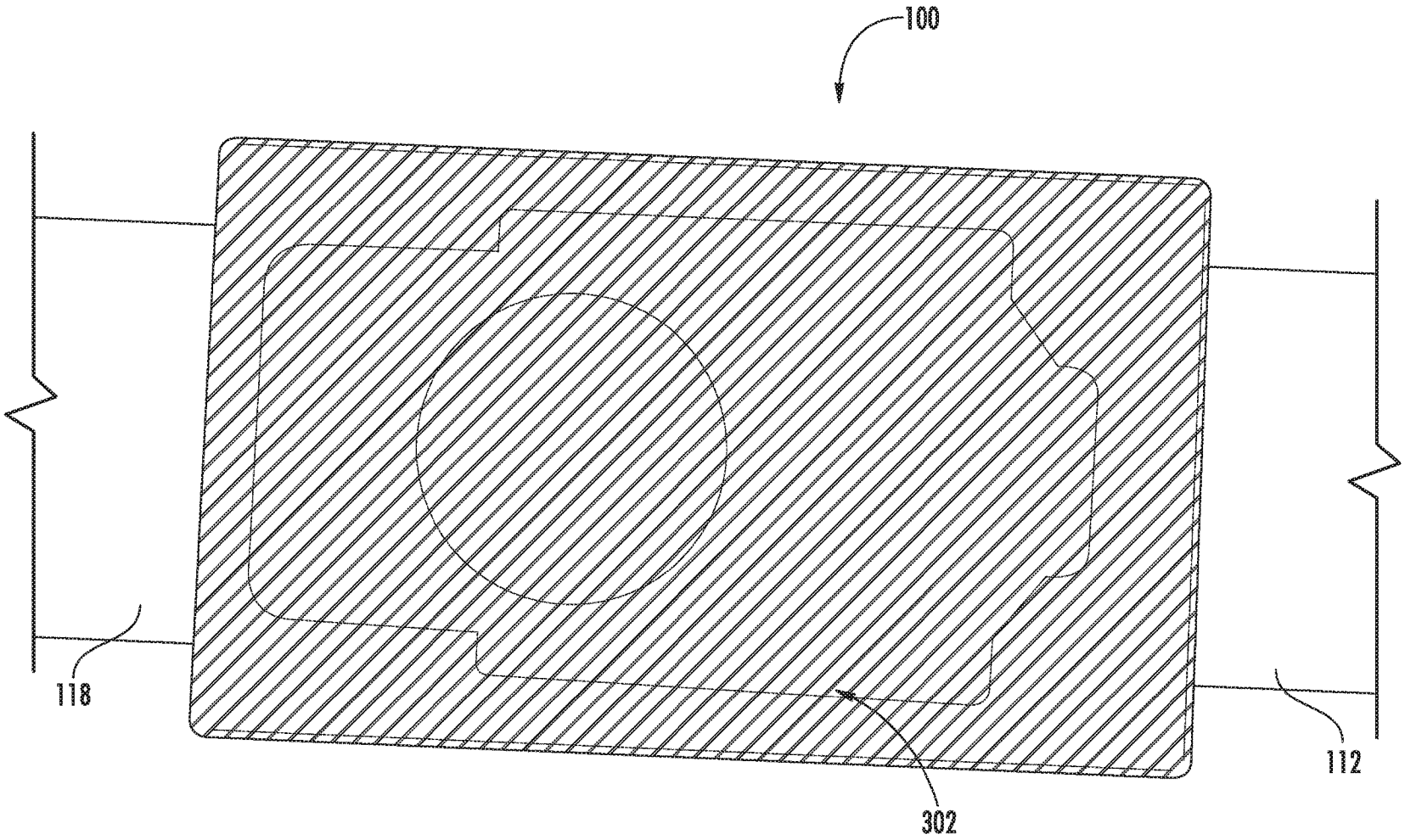
FIG. 3 shows a moisture insulation layer applied to the outer surface of the device shown in FIG. 1.
Figure 4:
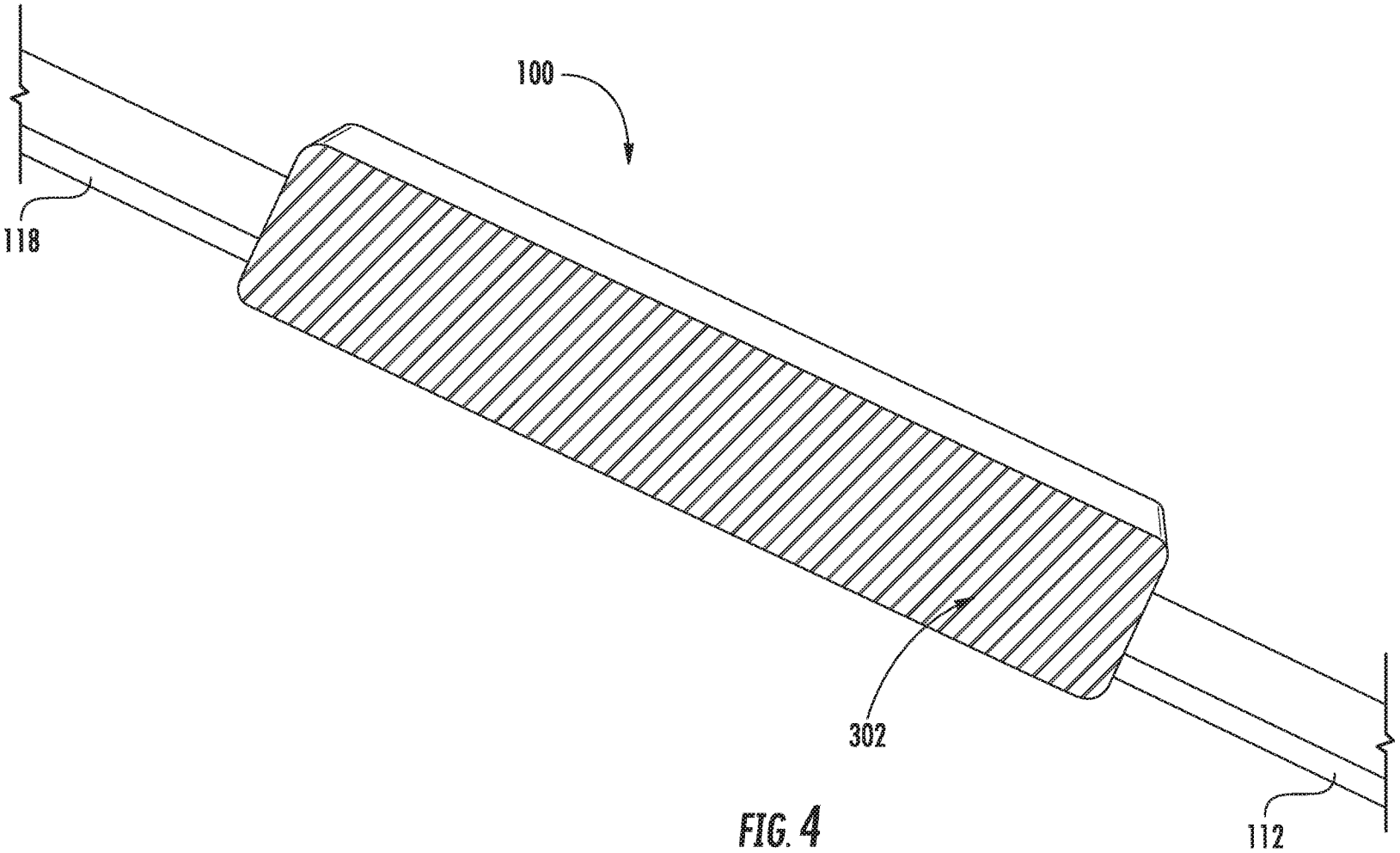
FIG. 4 shows that the moisture insulation layer is also applied to the lateral sides of a thermal cut-off device.
Figure 5:
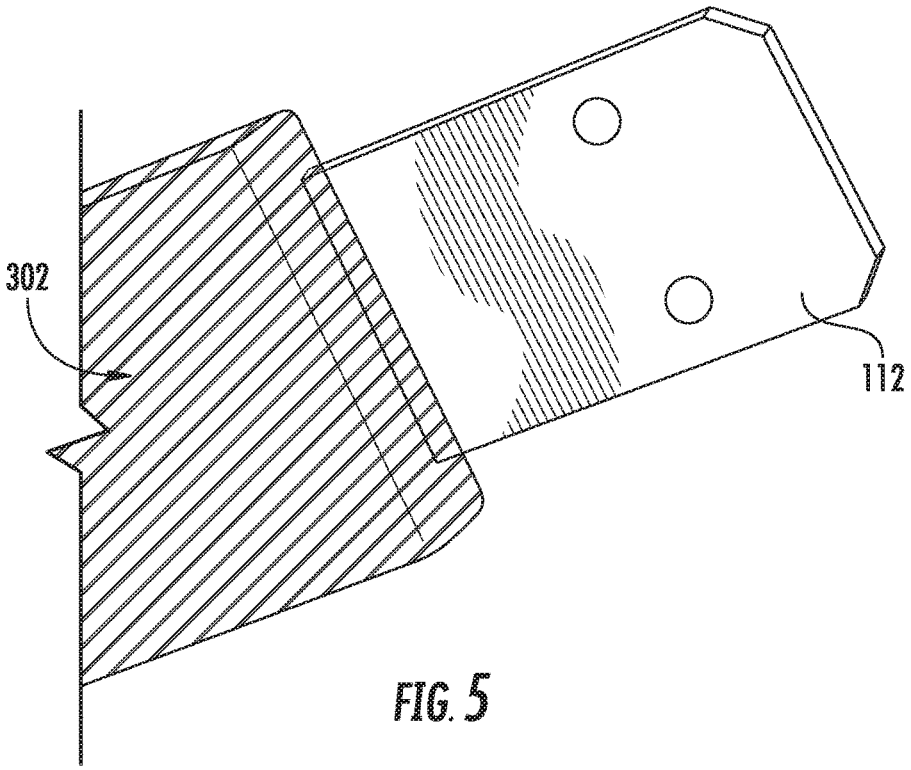
FIGS. 5 and 6 show that the moisture insulation layer is applied to the ends of a thermal cut-off device.
Figure 6:
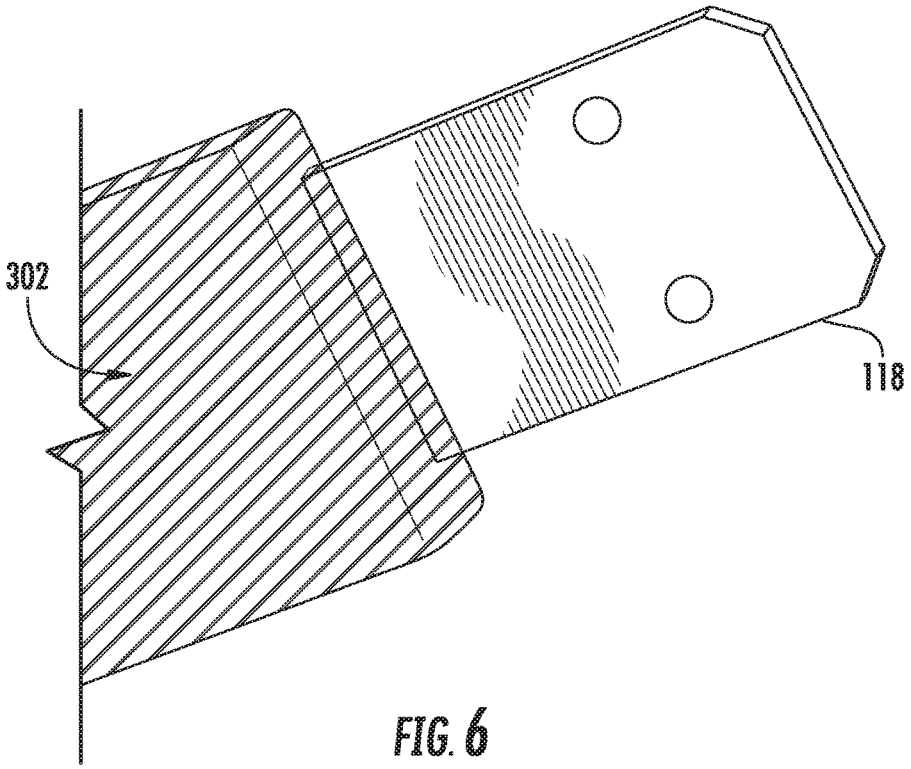

In this manner the device 100 protects a circuit from over-temperature conditions. FIG. 3 further shows a first moisture insulation layer 302 applied to the outer surface of the device 100. The moisture insulation layer 302 prevents corrosion of the temperature sensing element 108 under high temperature and moist environments, particularly moisture containing corrosive elements, including acetate ion and/or acid content. In particular, FIG. 3 shows the moisture insulation layer 302 applied to a top surface of the device. The moisture insulation layer 302 may be an epoxy adhesive that contains epoxy resin and a curing agent such as polyoxypropylenediamine, or UV/visible light-curable adhesives which have acrylated urethane. The layer 302 provides moisture resistance to minimize the ingress of moisture with corrosive agents, e.g. acetate ion and/or acid content into thermal cut-off device, thus preventing corrosion of the temperature sensing element. FIG. 4 shows that the moisture insulation layer 302 is also applied to the lateral sides of the device 100. FIGS. 5 and 6 show that the moisture insulation layer 302 is applied to the ends of the device from which the terminal portions 112 and 118 protrude.

Figure 7A:
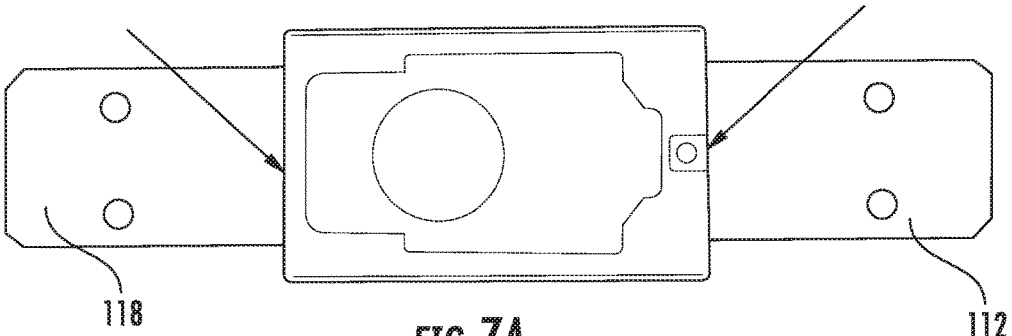
FIGS. 7*a*-7*c* demonstrate one of the processes for applying the moisture insulation layer to the outside surface of a thermal cut-off device, then using a brush to spread the adhesive on the device surface evenly.
Figure 7B:
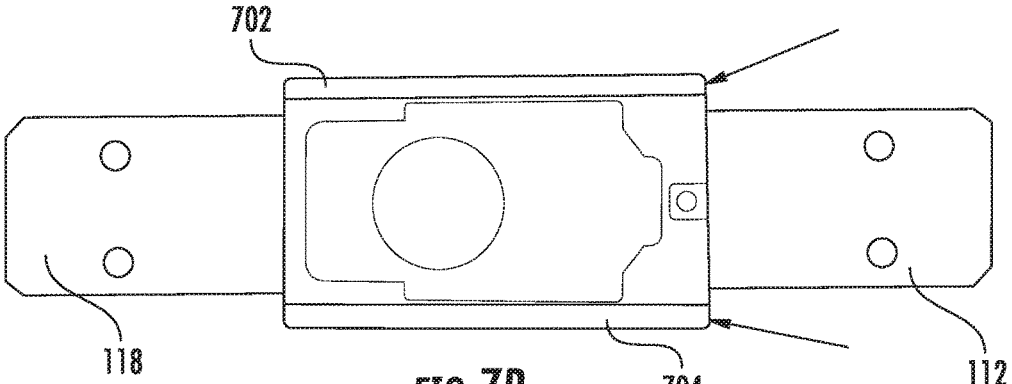
Figure 7C:
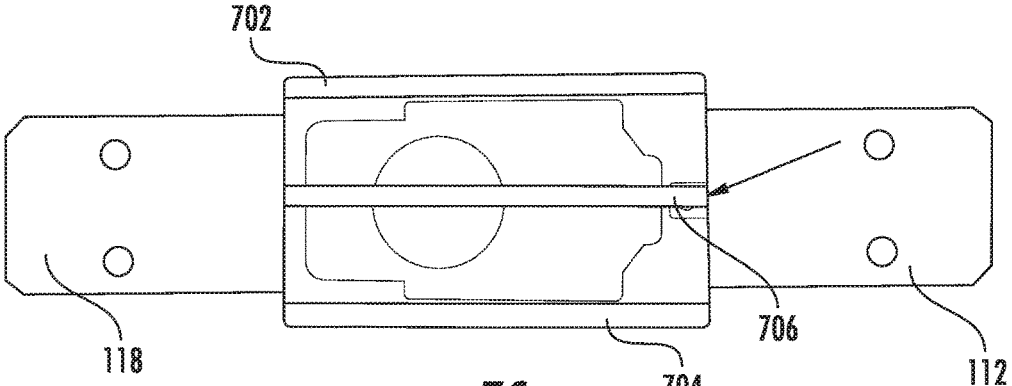

FIGS. 7*a*-7*c* demonstrate the process for applying the moisture insulation layer 302 to the outside surface of the thermal cut-off device 100, where the moisture insulation layer 302 is an epoxy. The device 100 may be loaded into a fixture or holding device. In FIG. 7*a*, an adhesive is applied at the corner of the electrode 112 or 118 and plastic frame 124 using a dispensing needle. The adhesive fills into the gap in that corner and seals the moisture ingress path.

As shown in FIG. 7*b*, epoxy lines 702 and 704 are applied on the edges of the top surface of the device 100. As shown in FIG. 7*c*, another epoxy line 706 is applied along a center of the top surface of the device 100. The epoxy is then brushed evenly over the top and side surfaces of the device 100.

Other adhesives such as UV/visible light-curable and light/heat curable material also can be applied by the same process method.

While the circuit protection device has been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that the thermal cut-off device is not to be limited to the particular embodiments disclosed, but to any embodiments that fall within the scope of the claims.

What is claimed is:

1. A thermal cut-off device comprising:

a base;

a first electrode positioned above the base and comprising a terminal portion;

a temperature sensing element positioned above a portion of the first electrode;

a second electrode positioned above the temperature sensing element and comprising a terminal portion;

a cover having edges that extend laterally and around edges of the base to form a structure that encloses the thermal sensing element, portions of the first and second electrodes, and at least a portion of the base such that the portion of the base is disposed within the cover, wherein the terminal portions of the first and second electrodes protrude from the structure formed by the cover and base; and a first moisture insulation layer coated on at least a portion of an outer surface of the structure formed by the cover and base;

wherein the edges of the cover extend longitudinally to form a t-slot, and the base includes a t-shaped longitudinal portion of the base, such that the t-shaped longitudinal portion of the base is received into the longitudinal t-slot of the cover.

2. The thermal cut-off device of claim 1, wherein the first moisture insulation layer comprises an epoxy adhesive.

3. The thermal cut-off device of claim 1, wherein the first moisture insulation layer comprises an epoxy resin comprising a curing agent.

4. The thermal cut-off device of claim 3, wherein the curing agent comprises polyoxypropylenediamine.

5. The thermal cut-off device of claim 1, wherein the first moisture insulation layer comprises a light-curable adhesive.

6. The thermal cut-off device of claim 1, wherein the first moisture insulation layer comprises a light and heat-curable adhesive.

7. The thermal cut-off device of claim 1, where the temperature sensing element comprises two or more expansion layers.

8. The thermal cut-off device of claim 1, wherein the temperature sensing element comprises a bimetal.

9. The thermal cut-off device of claim 1, wherein the temperature sensing element comprises a trimetal.

10. The thermal cut-off device of claim 1, wherein the temperature sensing element is curved such that a bottom surface of the temperature sensing element is a concave surface.

11. The thermal cut-off device of claim 10, wherein the temperature sensing element is configured to flip the orientation of the curve when a temperature of the device exceeds a predetermined temperature such that after the device reaches the predetermined temperature, a top surface of the temperature sensing element becomes the concave surface.

12. The thermal cut-off device of claim 11, wherein the temperature sensing element is configured to lift a portion of the second electrode when the orientation of the curve of the temperature sensing element flips upward such that an electrical connection between the first and second electrodes is severed.

13. The thermal cut-off device of claim 1, further comprising a positive temperature coefficient (PTC) chip positioned below the temperature sensing element.

14. The thermal cut-off device of claim 1, further comprising a second moisture insulation layer coated on the surface of the temperature sensing element.

15. The thermal cut-off device of claim 14, wherein the second moisture insulation layer comprises a contact lubricant or a contact coating.

16. The thermal cut-off device of claim 14, wherein the second moisture insulation layer provides a hydrophobic wax-based coating.

17. The thermal cut-off device of claim 14, wherein the second moisture insulation layer provides an electrically penetrable thin coating.

18. The thermal cut-off device of claim 15, wherein the second moisture insulation layer comprises a contact coating comprising a hydrophobic fluorinated polymer.

19. The thermal cut-off device of claim 1, wherein the cover includes a frame portion having an opening, and an over-mold portion, the over-mold portion disposed in the opening of the frame.

20. The thermal cut-off device of claim 1, wherein a frame portion of the cover surrounds each corner of the base.

* * * * *